US011629619B2

(12) United States Patent
Mueller et al.

(10) Patent No.: US 11,629,619 B2
(45) Date of Patent: Apr. 18, 2023

(54) METHOD FOR PRODUCING A CAMSHAFT ADJUSTER

(71) Applicant: Miba Sinter Austria GmbH, Laakirchen (AT)

(72) Inventors: Alexander Mueller, Altmuenster (AT); Markus Schauer, Gunskirchen (AT); Karl Dickinger, Vorchdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 175 days.

(21) Appl. No.: 17/377,812

(22) Filed: Jul. 16, 2021

(65) Prior Publication Data

US 2022/0056818 A1 Feb. 24, 2022

(30) Foreign Application Priority Data

Aug. 24, 2020 (AT) ..... A 50708/2020

(51) Int. Cl.

| | |
|---|---|
| ***F01L 1/344*** | (2006.01) |
| ***B22F 3/24*** | (2006.01) |
| ***B22F 5/08*** | (2006.01) |
| *F01L 1/46* | (2006.01) |

(52) U.S. Cl.

CPC ..... *F01L 1/3442* (2013.01); *B22F 3/24* (2013.01); *B22F 5/08* (2013.01); *B22F 2003/247* (2013.01); *F01L 1/46* (2013.01); *F01L 2301/00* (2020.05); *F01L 2303/00* (2020.05); *F01L 2303/01* (2020.05)

(58) Field of Classification Search

CPC ..... F01L 1/3442; F01L 1/46; F01L 2301/00; F01L 2303/00; F01L 2303/01; B22F 3/164; B22F 2003/166; B22F 3/24; B22F 2003/247; B22F 5/08

USPC ..... 123/90.17

See application file for complete search history.

(56) References Cited

U.S. PATENT DOCUMENTS

| | | | | |
|---|---|---|---|---|
| 10,094,251 | B2 | 10/2018 | Weber | |
| 10,316,703 | B2 | 6/2019 | Boese et al. | |
| 10,413,967 | B2 | 9/2019 | Tausend et al. | |
| 10,773,308 | B2 | 9/2020 | O'Hara et al. | |
| 2012/0132160 | A1* | 5/2012 | Malen | F01L 1/3442 123/90.15 |
| 2012/0222638 | A1* | 9/2012 | Arnold | F01L 1/3442 29/428 |

(Continued)

FOREIGN PATENT DOCUMENTS

| | | | |
|---|---|---|---|
| CN | 107795664 | A * | 3/2018 |
| CN | 112901301 | A * | 6/2021 |

(Continued)

*Primary Examiner* — Jorge L Leon, Jr.

(74) *Attorney, Agent, or Firm* — Collard & Roe, P.C.

(57) ABSTRACT

A camshaft adjuster is produced that includes a stator and a rotor, which is rotatable relative to the stator, wherein the stator and the rotor are produced with first planar surfaces on a first end face and with second planar surfaces on a second end face, which is formed to be opposite the first end face when viewed in an axial direction and wherein the rotor and/or the stator is or are produced according to a powder-metallurgical method, The first planar surfaces and the second planar surfaces of the stator and the rotor are ground or finished, and the lateral surface of the stator and the lateral surface of the rotor are left uncalibrated.

8 Claims, 4 Drawing Sheets

(56) References Cited

U.S. PATENT DOCUMENTS

| | | | | |
|---|---|---|---|---|
| 2012/0298061 | A1* | 11/2012 | Boese | F01L 1/3442 74/609 |
| 2015/0083065 | A1* | 3/2015 | Weber | F01L 1/344 419/61 |
| 2018/0135475 | A1* | 5/2018 | Heilig | F01L 1/3442 |
| 2019/0162084 | A1* | 5/2019 | Bohner | F01L 1/3442 |
| 2019/0375019 | A1* | 12/2019 | O'Hara | B22F 5/10 |
| 2020/0095905 | A1* | 3/2020 | Casellas | B22F 7/062 |

FOREIGN PATENT DOCUMENTS

| | | | | |
|---|---|---|---|---|
| DE | 10 2012 102 022 | A1 | 9/2013 | |
| DE | 10 2012 206 338 | A1 | 10/2013 | |
| DE | 10 2013 015 677 | A1 | 3/2015 | |
| DE | 10 2013 226 444 | A1 | 6/2015 | |
| DE | 10 2013 226 445 | A1 | 6/2015 | |
| DE | 102017114995 | A1 * | 1/2019 | F01L 1/344 |
| DE | 10 2017 127 676 | A1 | 5/2019 | |
| DE | 11 2017 006 718 | T5 | 9/2019 | |
| EP | 2372119 | A1 * | 10/2011 | B22F 3/164 |
| WO | WO-2016045669 | A1 * | 3/2016 | F01L 1/047 |

* cited by examiner

METHOD FOR PRODUCING A CAMSHAFT ADJUSTER

CROSS REFERENCE TO RELATED APPLICATIONS

Applicant claims priority under 35 U.S.C. § 119 of Austrian Application No. A50708/2020 filed Aug. 24, 2020, the disclosure of which is incorporated by reference.

BACKGROUND OF THE INVENTION

1. Field of the Invention

The invention relates to a method for producing a camshaft adjuster, in particular a hydraulic one, comprising a stator with a stator base body, which is produced with an outer spur gearing, a radially inner lateral surface and with webs protruding radially inwards from the radially inner lateral surface, which webs are distanced from one another in the circumferential direction of the stator base body, a rotor being rotatable relative to the stator and having a rotor base body, which is at least partially surrounded by the stator and which is produced with blades protruding radially outwards from a radially outer lateral surface, so that multiple hydraulic working spaces are formed between the stator and the rotor, each of which working spaces being subdivided into a first working chamber and a second working chamber by a blade of the rotor, wherein the stator and the rotor are produced with first planar surfaces on a first end face and with second planar surfaces on a second end face, which is formed to be opposite the first end face when viewed in an axial direction, wherein the rotor and/or the stator is or are produced according to a powder-metallurgical method comprising the method steps: providing a first powder for producing the rotor; pressing the first powder to form a rotor green compact; possibly green machining the rotor green compact; sintering the rotor green compact; post-processing the rotor by means of material removal; and/or comprising the method steps: providing a second powder for producing the stator; pressing the second powder to form a stator green compact; possibly green machining the stator green compact; sintering the stator green compact; post-processing the stator by means of material removal; possibly hardening the spur gearing of the stator.

The invention further relates to a single-piece stator for a camshaft adjuster made from a sintering material, comprising a stator base body, which has an outer spur gearing, a radially inner lateral surface and webs protruding radially inwards from the radially inner lateral surface, which webs are distanced from one another in the circumferential direction of the stator base body, wherein the stator has first planar surfaces on a first end face and second planar surfaces on a second end face, which is arranged opposite the first end face when viewed in an axial direction.

Moreover, the invention relates to a single-piece rotor for a camshaft adjuster made from a sintering material, comprising a rotor base body, which has blades protruding radially outwards from a radially outer lateral surface, wherein the rotor has first planar surfaces on a first end face and second planar surfaces on a second end face, which is arranged opposite the first end face when viewed in an axial direction.

The invention also relates to a camshaft adjuster, in particular a hydraulic camshaft adjuster, comprising a stator and a rotor, wherein the rotor is at least partially arranged inside the stator.

2. Description of the Related Art

Camshaft adjusters are known to serve for adjusting the valve opening times in order to thus achieve a higher efficiency of a combustion engine. Various embodiments of them are known from the prior art. A hydraulic camshaft adjuster comprises a stator, in which a rotor is arranged. The rotor is connected to the camshaft so as to be prevented from rotating in relation thereto. The stator, which is connected to the crankshaft, has webs protruding radially inwards, which webs form the stop faces for the blades of the rotor. Thus, the rotor can only by rotated by a predefined angle range relative to the stator.

In this context, it is also known to powder-metallurgically produce at least parts of a camshaft adjuster from sintering materials. For example, DE 10 2013 226 444 A1 describes a camshaft adjuster for an internal combustion engine of the vane cell type, having a stator and a rotor, which can be rotated relative to the stator and which consists of a plurality of rotor parts which are connected to one another, wherein the rotor can be connected to a camshaft of the internal combustion engine so as to be prevented from rotating in relation thereto, and a first rotor part is configured in such a way that the camshaft is supported with contact on the first rotor part in an operating state, wherein the first rotor part is produced by means of a sintering process, and at least a first supporting surface, which supports the camshaft, of the first rotor part is set geometrically by means of a non-cutting processing operation.

DE 10 2013 015 677 A1 describes a method for producing a sintered part with high radial precision, wherein the sintered part is produced from at least a first sintered adherend and a second sintered adherend, and wherein the method comprises at least the following steps: joining the first sintered adherend to the second sintered adherend, causing the high radial precision, having a deformation of at least one radial deformation element, which is preferably positioned so as to adjoin a joining contact zone, wherein deforming the radial deformation element is effected at least by a calibration tool and is carried out substantially as a plastic deformation of the radial deformation element.

SUMMARY OF THE INVENTION

The underlying object of the present invention is to simplify the production of a hydraulic camshaft adjuster.

The object of the invention is achieved by the initially mentioned method, in which it is provided that the first planar surfaces or the second planar surfaces of the stator and of the rotor are ground or finished, and that the lateral surface the stator, in particular the entirety of the stator base body, and the lateral surface of the rotor, in particular the entirety of the rotor base body, are left uncalibrated.

The object of the initially mentioned stator is further achieved in that the first planar surfaces and the second planar surfaces of the stator are ground or finished, and that the lateral surface, in particular the entire stator base body, is uncalibrated.

Moreover, the object of the initially mentioned rotor is achieved in that the first planar surfaces and the second planar surfaces of the rotor are ground or finished, and that the lateral surface the rotor, in particular the entire rotor base body, is uncalibrated.

The object is also achieved with the initially mentioned camshaft adjuster, in which the stator and/or the rotor is formed according to the invention.

In this regard, it is advantageous that by avoiding the calibration step, a method step can be eliminated as the grinding of the planar surfaces can also be carried out simultaneously according to an embodiment variant. During calibration, the sintered component is subjected to a high pressure in a calibration die, so that component inaccuracies can be weakened and/or eliminated due to the precision of the calibration die. This does not only require time and energy, but the flashes that have possibly occurred must subsequently be removed. Saving said method step of "calibration" thus allows realizing corresponding advantages both with respect to resource utilization and with respect to production cost of the components. Deflashing may possibly also be entirely omitted, whereby a further advantage with respect to the shortening of the method and cost reduction can be achieved.

According to an embodiment variant of the invention, it may be provided that the rotor and the stator are arranged on a common clamping device, and that the planar surfaces to be ground are ground together. Hence, a stator-rotor set coordinated with one another for a camshaft adjuster can be provided, whereby the tolerances of the component pairing can be further reduced. Moreover, the processing time for the production of the camshaft adjuster can be reduced thereby.

According to a further embodiment variant of the invention, it may be provided that three support elements are formed on the stator and/or on the rotor, on the planar surfaces of the first end face or the planar surfaces of the second end face, after that, the planar surfaces not provided with the support elements are ground, subsequently, the support elements are removed and subsequently to that, the planar surfaces not yet ground are ground. Thus, it is possible to provide the accuracy of the flatness of the ground planar surfaces more easily.

According to an embodiment variant in this regard, it may be provided that the support elements are formed as one piece with the stator and/or the rotor. In other words, these support elements are already produced during the production of the stator and/or the rotor, which can also reduce the production time of the two components. In particular, this approach is advantageous for sintered components as the support elements can already be formed during the production of the green compact.

According to further embodiment variants of the invention, it may be provided that the support elements are made from a material that is plasticizable during the assembly of the camshaft adjuster, and/or that the support elements are made from a polymer-based material. With these embodiment variants, the effort for removing the support elements after surface grinding can be reduced as the support elements can be either compressed and/or plasticized such that they no longer disrupt the operation of the camshaft adjuster, or as the removal of the support elements can be carried out using relatively little energy.

For further improving the flatness of the ground planar surfaces, it may be provided according to a different embodiment variant that the support elements are formed to be knob-shaped, whereby the support surface of the support elements, for example on a processing machine, can be reduced.

According to further embodiment variants of the invention, it may be provided that the distance from the first to the second planar surfaces of the stator has a tolerance of 10 μm to 25 μm, and/or that the distance from the first to the second planar surfaces of the rotor has a tolerance of 8 μm to 25 μm. Thus, a camshaft adjuster having a relatively small clearance between the stator and the rotor can be provided.

BRIEF DESCRIPTION OF THE DRAWINGS

For the purpose of better understanding of the invention, it will be elucidated in more detail by means of the figures below.

These show in a simplified schematic representation.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
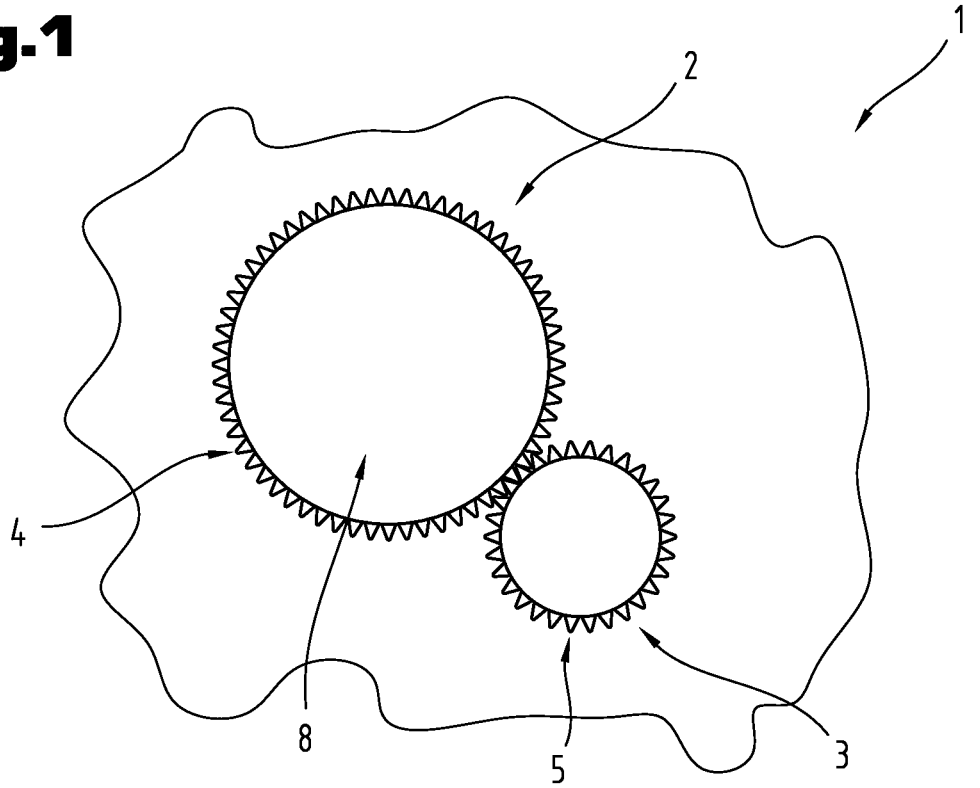
FIG. 1 shows a cutout from a combustion engine.

FIG. 1 shows a cutout from a combustion engine 1. A hydraulic camshaft adjuster 2 and a drive wheel 3 are shown. The camshaft adjuster 2 has a spur gearing 4 on its outer circumference. The drive wheel 3 also has a spur gearing 5 on its outer circumference. The two spur gearings 4, 5 are arranged in a meshing engagement with one another.

The spur gearing 4 of the camshaft adjuster 2 can also be configured for engaging with a timing chain or a driving belt (not shown).

In principle, this configuration of hydraulic camshaft adjusters 2 is known from the prior art, so that further explanations regarding this can be dispensed with.

Figure 3:
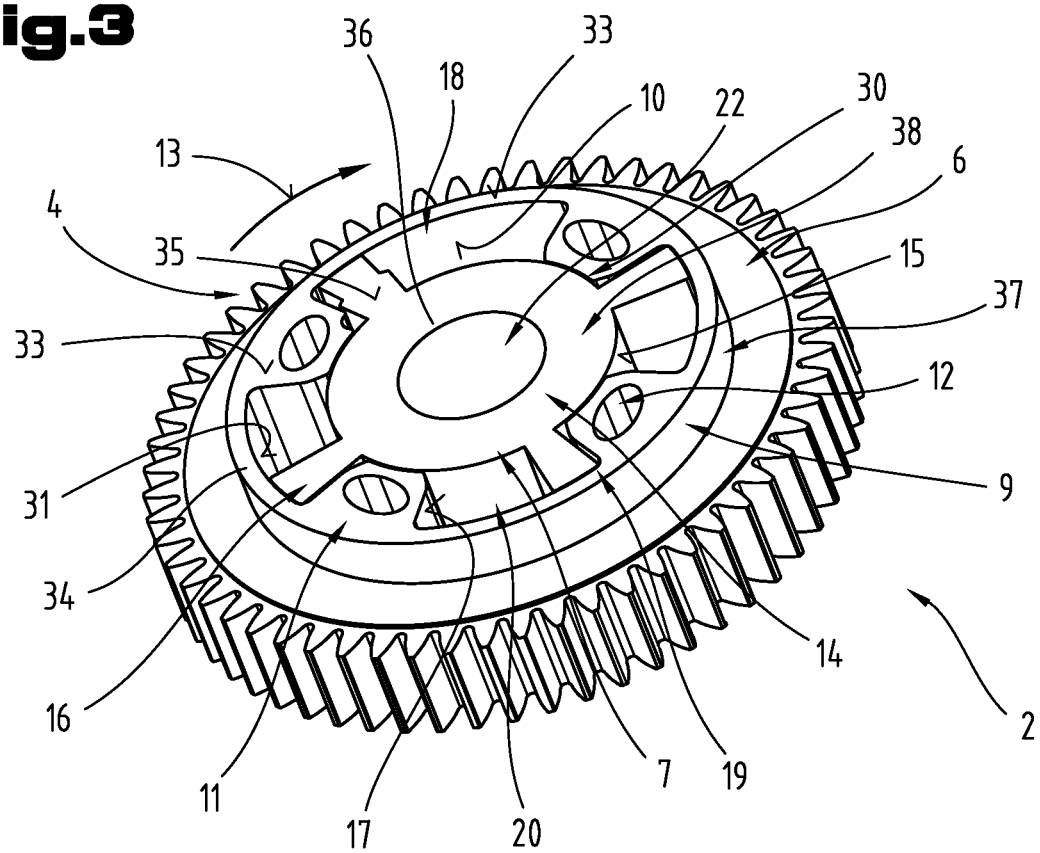
FIG. 3 shows the stator and the rotor of the camshaft adjuster according to FIG. 2 in an oblique view.
Figure 2:
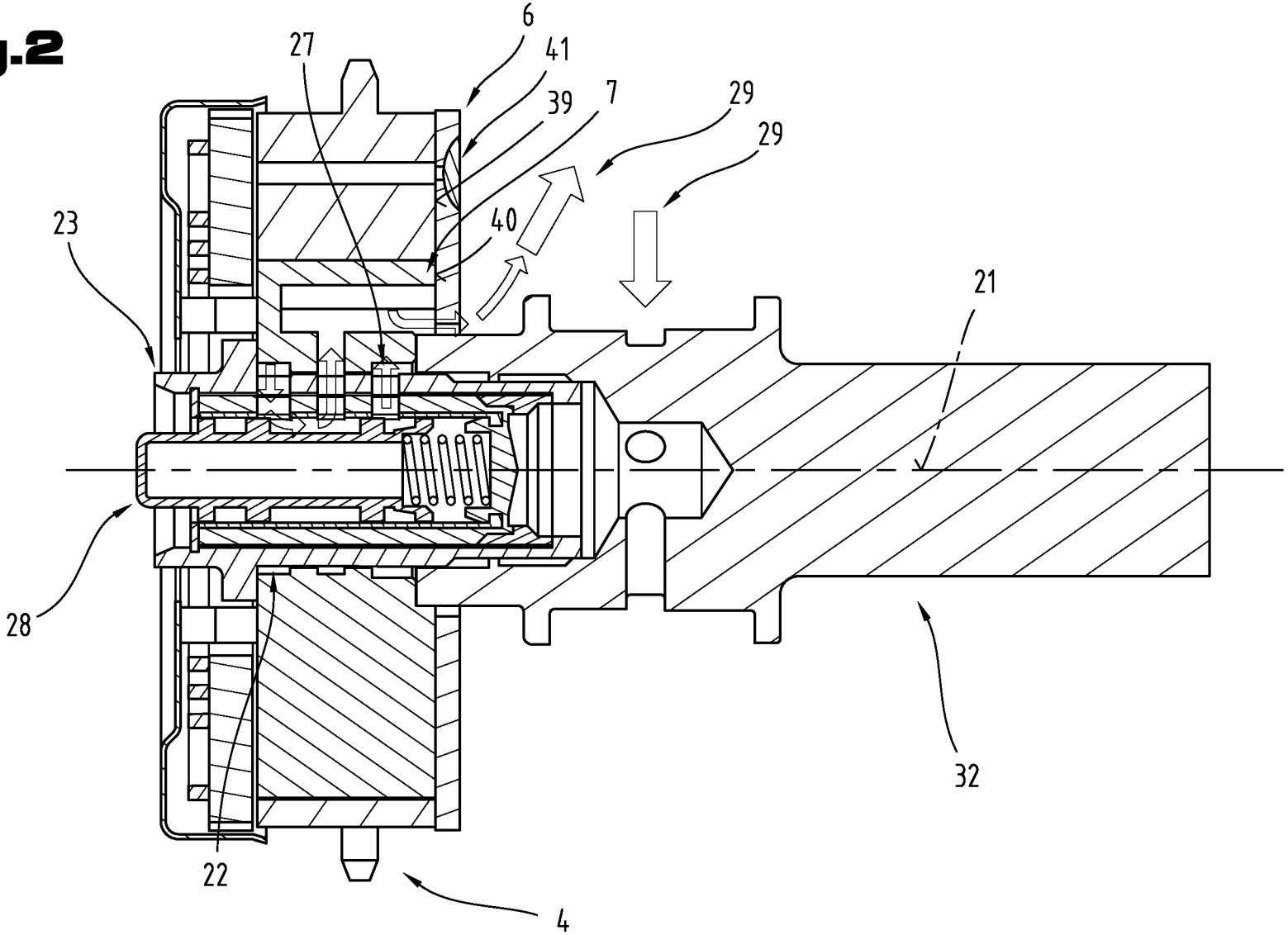
FIG. 2 shows a cutout from a hydraulic camshaft adjuster in a longitudinal section.
Figure 4:
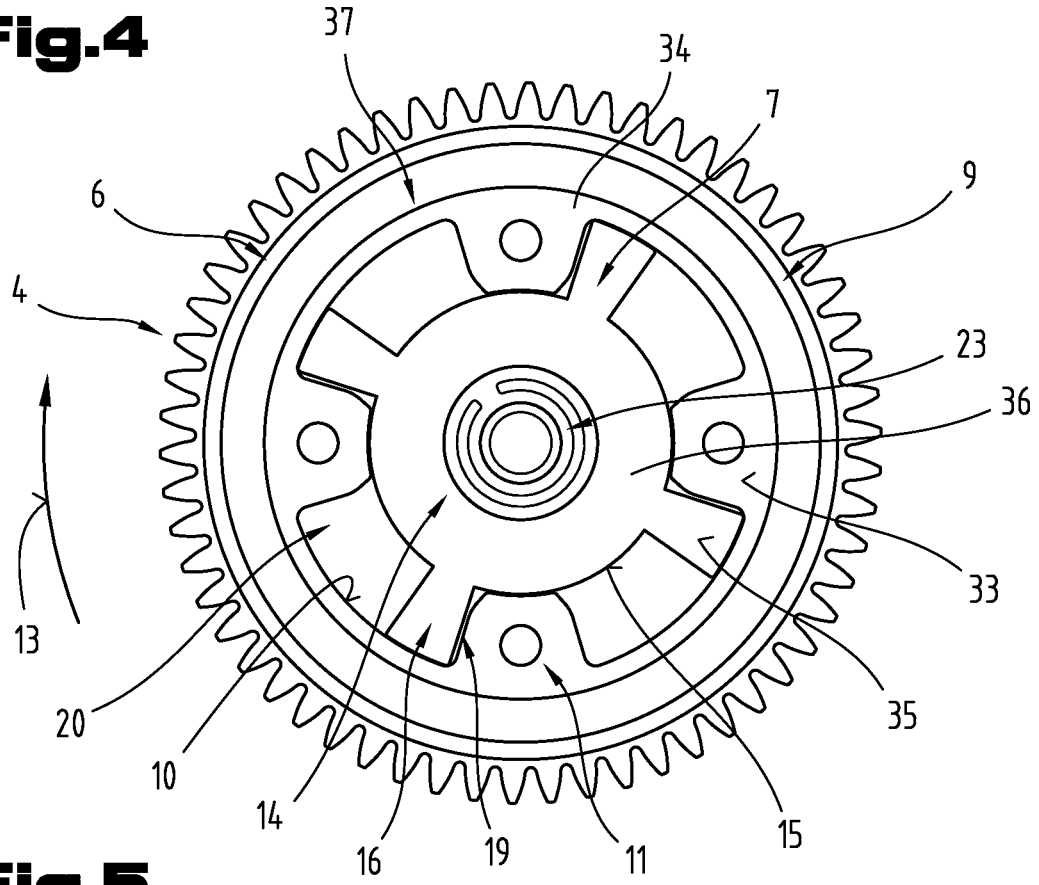
FIG. 4 shows the stator and the rotor of the camshaft adjuster according to FIG. 2 in a front view.

As can be seen in FIGS. 2 to 4, the camshaft adjuster 2 has a stator 6 and a rotor 7. The representation of a covering 8 on the front side of the camshaft adjuster 2 that can be seen in FIG. 1 was dispensed with in FIGS. 3 and 4.

The stator 6 has an annular stator base body 9, which has the outer toothing in the form of the spur gearing 4 on its outer circumference—as previously mentioned. Webs 11 are formed on a radially inner lateral surface 10 of the stator base body 9 so as to protrude radially inwards beyond said lateral surface 10. In the particular case, the stator 6 has four webs 11. This number of webs 11, however, is not to be understood as limiting. It is also possible for more or fewer webs 11 to be present. The webs 11 may optionally be provided with a recess 12 and/or an opening in order to lower the weight of the stator 6. The webs 11 are arranged on the stator base body 9 so as to be distanced from one another in a circumferential direction 13.

Within the stator 6, the rotor 7 is completely arranged and/or at least partially arranged—as mentioned before, the representation of the coverings 8 (FIG. 1) was omitted. The rotor 7 has an (annular) rotor base body 14. On an outer lateral surface 15 of said rotor base body 14, blades 16 are formed and/or arranged, which extend radially outwards starting from the lateral surface 15. In an assembled state of the camshaft adjuster 2, said blades 16 are arranged between the webs 11 of the stator 6. In this regard, side surfaces 17 of the webs 11 form the stop faces for the blades 16 of the rotor 7, as it is evident from FIG. 3.

The number of blades 16 of the rotor 7 is determined by the number of webs 11 of the stator 6, with the result that, in the specific case, thus four blades 16 are present.

The webs 11 define hydraulic working spaces 18. One working space 18 each is limited in the circumferential direction 13 by two webs 11. The blades 16, which are arranged between the webs 11, divide the working spaces 18 into a first working chamber 19 and a second working chamber 20, in each case by means of one blade 16 of the rotor 7. The relative position of the rotor 7 to the stator 6 can be changed by means of the fluid which can be introduced into said working chambers 19, 20, as it is known per se, so that regarding this, reference is made to the relevant prior art.

It should be noted that the hydraulic embodiment of the camshaft adjuster 2 is the preferred one. However, the camshaft adjuster 2 can also be designed differently.

The rotor 7 is thus arranged within the stator 6 so as to be rotatable (pivotable) relative to the stator 6 in the circumferential direction 13, wherein the path of the rotatability (pivotability) is limited by the webs 11. The camshaft adjuster 2 thus works according to the principle of a swivel motor. Driven by a chain or a belt drive or the drive wheel 3, the camshaft adjuster 2 adjusts the opening and closing times of the gas exchange valves at an earlier or later time with respect to the driving shaft, such as the crankshaft, in order to influence on the combustion process in the internal combustion engine. In this regard, the camshaft is adjusted either in the direction "early" or in the direction "late" by filling the opposing working chambers 19, 20 forming between the rotor 7 and the stator 6 of the camshaft adjuster 2 with a suitable hydraulic medium.

A control valve 23 (which may also be referred to as central valve) is arranged at least partially inside a recess 22 of the rotor 7 extending in an axial direction 21 and/or particularly passing through the rotor 7, meaning so as to be at least partially surrounded by the rotor 7.

Figure 5:
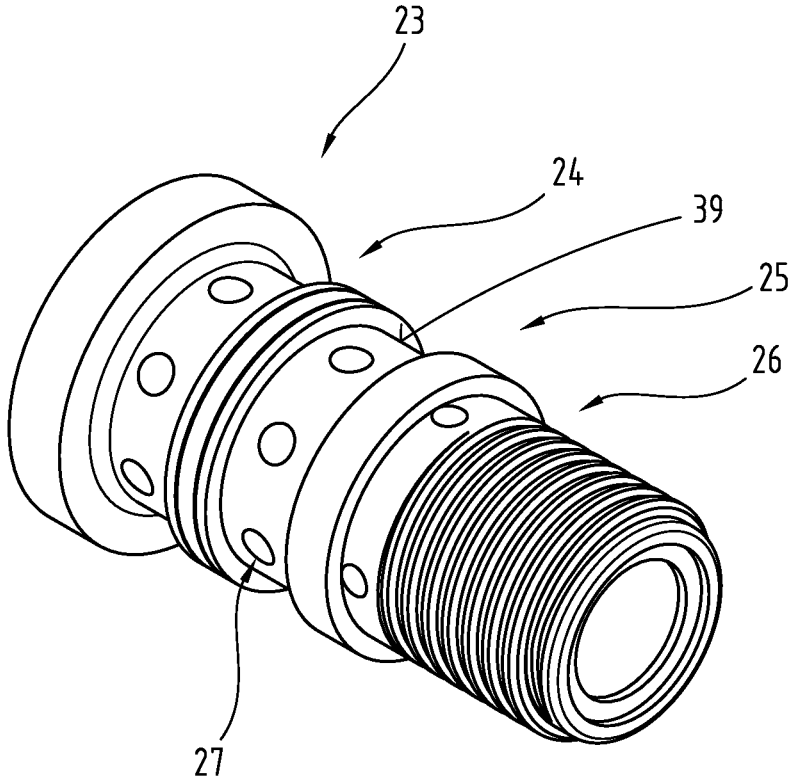
FIG. 5 shows a control valve.

FIG. 5 shows an embodiment variant of the control valve 23. Said control valve 23 has multiple conical or cylindrical sections 24 to 26 with openings 27 (bores), through which the hydraulic fluid can be fed into and/or discharged from the working chambers 19, 20, depending on the position of a piston 28. A circuit for the hydraulic fluid (in particular, an oil) is adumbrated with arrows 29 in FIG. 2.

The piston 28 may be actuated magnetically, for instance.

For the sake of completeness, it should be mentioned that the working spaces 18 and thus also the working chambers 19, 20 are limited radially inwards by a surface 30 of the rotor base body 14 (in particular by its lateral surface 15) and radially outwards by a surface 31 of the stator base body 9 (in particular by its lateral surface 10).

Furthermore, seals may be arranged on the blades 16, which seals seal a distance between the blades 16 and the surface 30 (in particular the lateral surface 10) during operation of the hydraulic camshaft adjuster 2. These seals may be arranged partially inside the blades 16, for which purpose the blades 16 may have slits, as is adumbrated in dashed lines in FIG. 4.

Feeding the hydraulic fluid to the working chambers 19, 20 can be carried out by means of a camshaft 32, which is arranged on the camshaft adjuster 2.

For conducting the hydraulic fluid, corresponding channels and/or lines may be provided and/or arranged in components of the camshaft adjuster 2 and/or the camshaft 32.

The rotor 7 preferably is a single-piece component, preferably a sintered component, so that the blades 16 thus form a single, integral component, in particular a sintered component, with the rotor base body 14.

Likewise, the stator 6 preferably is a single-piece component, preferably a sintered component.

For further details on hydraulic camshaft adjusters 2, which are not related to the invention, reference is made to the relevant prior art.

The production of the rotor 7 is preferably carried out using a powder-metallurgical method. This method comprises the method steps:

providing a first powder for producing the rotor 7 in a mold cavity of a mold;

pressing the first powder to form a rotor green compact in the mold;

possibly green machining the rotor green compact;

sintering the rotor green compact;

post-processing the rotor by means of material removal;

The stator 6 is also preferably a single-piece component, in particular a sintered component (meaning it was produced from a sintering material according to a powder-metallurgical method), so that the spur gearing 4 and the webs 11 thus form a single, integral component, in particular a sintered component, with the base body 9. This method comprises the method steps:

providing a second powder for producing the stator 6 in a mold cavity of a mold;

pressing the second powder to form a stator green compact in the mold;

possibly green machining the stator green compact;

sintering the stator green compact;

post-processing the stator 6 by means of material removal;

possibly hardening the spur gearing 4 of the stator 6.

The green machining and/or the post-processing by means of material removal of the stator 6 and/or of the rotor 7 can be carried out for example by sanding, lapping, honing etc.

The hardening of the spur gearing 4 can be carried out for example by inductive hardening, quench hardening, case-hardening etc.

The sintering process of the stator 6 and/or the rotor 7 can have one or multiple stages. Moreover, it can be carried out at a temperature of 700° C. to 1300° C. for a period of 10 minutes to 120 minutes, for instance.

As the powder-metallurgical production of sintered components is known per se from the prior art, reference is made to the relevant prior art in order to avoid repetitions in this regard.

The stator 6 has first planar surfaces 33 which are formed on a first end face 34 of the stator 6. The rotor 7 also has first planar surfaces 35 which are formed on a first end face 36 of the rotor 7. The first planar surfaces 33 of the stator 6 are arranged in an aligning manner to the first planar surfaces 35 of the rotor 7 within the tolerances, as is shown in particular in FIGS. 3 and 4.

The first planar surfaces 33 of the stator 6 are formed on the webs 11, and in the embodiment variant shown, they are formed on an annular web 37 of the stator base body 9, wherein these first planar surfaces 33 of the stator 6 extend at least over the entire end faces of the webs 11 and the annular web 37 in the embodiment variant shown. The first planar surfaces 33 of the stator 6 may, however, also extend over only a part of said surfaces, for example if the webs 11 are graduated.

The first planar surfaces 35 of the rotor 7 are formed on the blades 16, and in the embodiment variant shown, they are formed on the end faces 36 of a hollow cylinder 38 of the rotor base body 14 (and/or which forms the rotor base body 14), wherein these first planar surfaces 35 of the rotor 7 extend at least over the entire end faces of the blades 16 and the hollow cylinder 38 in the embodiment variant shown. The first planar surfaces 35 of the rotor 7 may, however, also extend over only a part of said surfaces, for example if the blades 16 or the hollow cylinder 38 are graduated.

Opposite the first planar surfaces 33, 35 of the stator 6 and/or rotor 7 in the axial direction 21, the stator 6 has second planar surfaces 39 and the rotor 7 has second planar surfaces 40. The second planar surfaces 39 of the stator 6 are formed on second end faces of the stator 6, and the second planar surfaces 39 of the rotor 7 are formed on second end faces of the rotor 7. The second end faces of the stator 6 and of the rotor 7 are located opposite the first end face 34 of the stator 6 and the first end face 36 of the rotor 7 in the axial direction 21 and delimit the stator base body 9 and/or the rotor base body 14 on their second side. These second planar surfaces 39 of the stator 6, as well, are arranged in an aligning manner to the second planar surfaces 40 of the rotor 7 within the tolerances. They may form the entire second end faces of the stator 6 and/or the rotor 7 or only a part thereof. The second planar surfaces 39 of the stator 6 and the second planar surfaces 40 of the rotor 7 abut on a covering 41 of the camshaft adjuster 2, in particular in a sealing manner (within the tolerances), which covering 41 is connected, for example screwed, to the stator 6.

It is provided that the first planar surfaces 33, 35 and the second planar surfaces 39, 40 of the stator 6 and the rotor 7 are ground or finished. Preferably, only the first planar surfaces 33, 35 and the second planar surfaces 39, 40 of the stator 6 and the rotor 7 are ground or finished.

In other words, the sealing surfaces of the stator 6 and the rotor 7 are ground on both sides (viewed in the axial direction 21).

The lateral surface 9 of the stator 6, on which the webs 11 are arranged, and the lateral surface 15, on which the blades 16 are arranged, are not calibrated, preferably, these surfaces are completely unprocessed, for example by these surfaces being produced to net shape or near net shape quality. Preferably, the entire stator base body 9 and the entire rotor base body 14 are uncalibrated. However, it is possible that the outer toothing of the stator 6 (however, not its lateral surface 9) is calibrated.

Grinding and/or finishing the first planar surfaces 33, 35 and the second planar surfaces 39, 40 of the stator 6 and the rotor 7 may be carried out using conventional grinding devices and/or finishing devices known from the prior art. In particular, grinding and/or finishing these surfaces produces a surface roughness Rz according to DIN EN DIN EN ISO 4287 of less than 16 μm, in particular between 1 μm and 14 μm.

Figure 6:
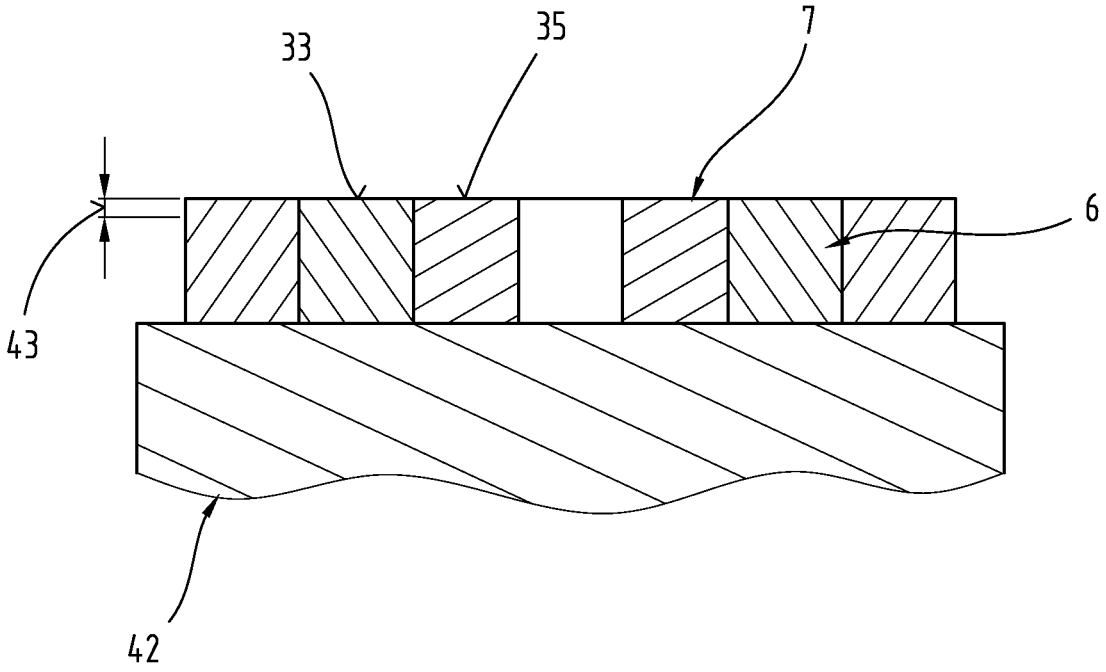
FIG. 6 shows the common arrangement of a stator and a rotor in a clamping device.

FIG. 6 shows an embodiment variant of the method. It is possible that the stator 6 and the rotor 7 are ground separately from each other. However, according to this embodiment variant, it is provided that the rotor 7 and the stator 6 are arranged on a clamping device 42 and the planar surfaces 33, 35 and/or 39, 40 to be ground are ground together. In this process, a layer thickness 43 of the rotor 7 and the stator 6 are removed on these planar surfaces 33, 35 and/or 39, 40. This layer thickness 43 may for example amount to between 1 μm and 80 μm. In order to make the material removal of the stator 6 and the rotor 7 possible to this extent, at least these layer thicknesses 43 are taken into account in the production of the stator 6 and the rotor 7, i.e. these two components are produced being higher (viewed in the axial direction 21) by at least these layer thicknesses 43 (i.e. in each case, twice the layer thickness 43 for the stator 6 and the rotor 7).

It should be noted that with the clamping device 42 shown in FIG. 6, only one side can be processed, and subsequently a reclamping operation has to take place for processing the second sides of the rotor 7 and the stator 6. However, a clamping device 42 allowing the simultaneous grinding of the stator 6 and the rotor 7 from both may also be used.

In the embodiment variant of joint grinding of the stator 6 and the rotor 7 it is advantageous if these two components are also subsequently packaged together and delivered to the end consumer as a set, as the stator 6 and the rotor 7 can be better coordinated with each other due to the joint grinding.

Figure 7:
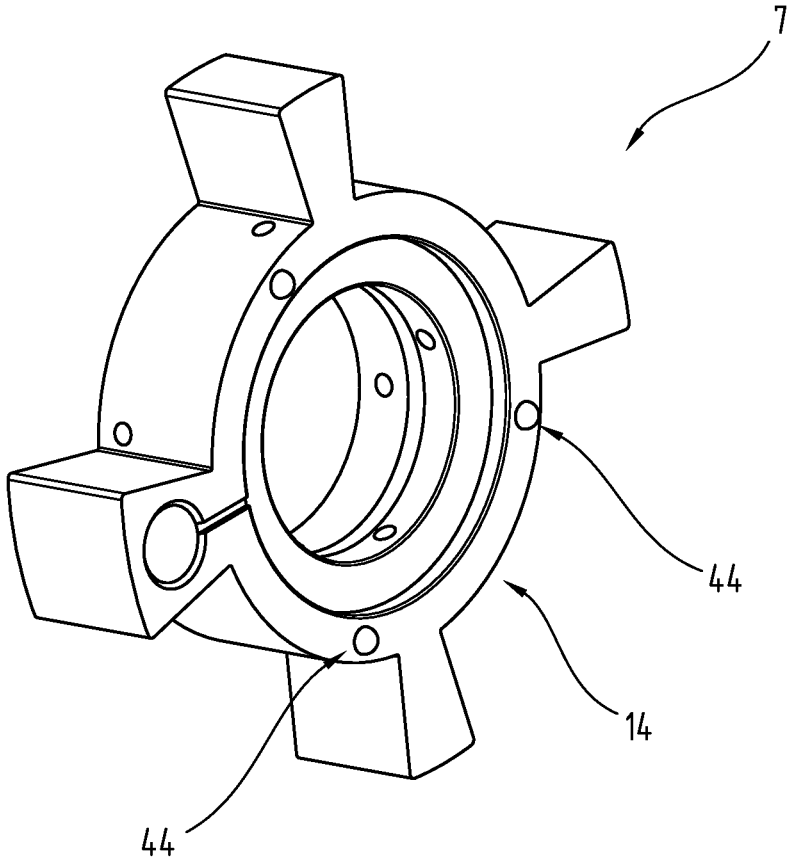
FIG. 7 shows an embodiment variant of a rotor.

FIG. 7 shows an embodiment variant of the rotor 7. In this embodiment variant, multiple support elements 44 are provided on the rotor base body 14.

During the pressing of the powder, at least three support elements 44 may also be formed on the green compact for the rotor 7, on the first or second planar surfaces 34 or 40 not to be ground, so as to protrude beyond them in the axial direction 21. Preferably, exactly three support elements 44 are formed. However, more than three support elements 44 may also be formed, for example four, five, six etc.

For forming the elevations on the green compact, a punch in particular is used for pressing the powder, which has corresponding recesses where the support elements 44 are.

As can be seen in FIG. 7, the support elements 44 are not arranged in one line, i.e. not on a straight line. In fact, in the case of three support elements 44, the support elements 44 are arranged and/or formed at the corner points of an equilateral triangle, i.e. in each case offset to each other by 120°, according to a preferred embodiment variant.

It is further preferred for the support elements 44 to be arranged on the planar surfaces 35, 40 at the same radial height, as can also be seen in FIG. 7.

In principle, the support elements 44 may be arranged at any suitable location on the planar surfaces 35, 40 or also on the rotor base body 14.

The support elements 44 may also be formed to be cylindrical. However, they may also have a different shape, in particular a hemispherical shape or the shape of a spherical cap or a cuboidal shape or a pyramidal shape etc. Preferably, they are formed to be knob-shaped.

Preferably, all support elements 44 of the rotor 7 have the same shape. However, it is also possible to provide mixed variants, so that, for example, a part of the support elements 44 is cylindrical and the rest is formed in the shape of a spherical cap. Other mixed variants are also conceivable.

The support elements 44 thus extends/extend over at least a partial area of the respective planar surface 35 or 40 of the rotor, wherein they preferably take up a relatively small space, so that reference may also be made to support points. For this purpose, the support elements 44 may each have a maximum cross-sectional area which is selected from a range of 1 $mm^2$ to 10 $mm^2$, viewed in the axial direction.

The support elements 44 may be produced with a maximum height, measured from the respective planar surface 35 or 40 of the rotor, which height is selected from a range of 1 μm to 80 μm, in particular from a range of 2 μm to 20 μm.

The support elements 44 may also be formed to be approximately strip-shaped, so that they thus have a length greater than the width, although this is not the preferred embodiment variant.

Generally, the embodiments regarding the support elements 44 may also be applied to the stator 6, so that the stator 6 may thus also have such support elements 44 on the planar surfaces 33 or 39 not to be ground.

However, in addition to this single-piece embodiment variant of the support elements 44 with the rotor 7 and/or the stator 6, it is also possible, according to further embodiment variants, to arrange them separately on it/them, in particular after sintering the rotor 7 and/or the stator 6. For this purpose, the support elements 44 may be made, for example from a film and be glued to the respective planar surfaces 33, 35 or 39, 40. The support elements 44 may also be sintered onto the rotor 7 and/or the stator 6 as separate elements and/or be connected thereto in a different manner.

According to a different embodiment variant, the support elements 44 may be produced as a partial coating or print made of a polymer-based material. For example, the support elements 44 may be produced from a polyamide resin, in which at least one solid lubricant, such as graphite or molybdenum disulfide, may be contained. The resin is hardened, for example thermally or by means of UV radiation, after or during the application onto the relevant areas. This embodiment variant of the support elements 44 has the advantage that the support elements 44 can be removed relatively easily from the stator 6 and/or from the rotor 7, and/or possibly even come off automatically.

That is to say that the support elements 44 are removed after the first or second planar surfaces 33, 34, 39, 40 of the stator 6 and/or the rotor 7 are ground or finished.

The removal may be carried out, for example, by means of machining methods or by brushing etc.

After removing the support elements 45, the planar surfaces 33, 34, 39, 40, from which said support elements 45 were removed, are ground or finished.

According to a further embodiment variant of the invention, it may be provided that the support elements 44 are made from a material that is plasticizable during the assembly of the camshaft adjuster 2. Here, plasticizable means that the support elements 44 are plastically deformable. This may be achieved by the support elements 44 being produced from a softer material than the rest of the stator 6 or the rotor 7. As an alternative or in addition to this, it is also possible to produce the support elements 44 having cavities, for example having pores, which are at least partially compressed upon plastic deformation. For this purpose, the support elements 44 may be made from a sintering material. As explained above, however, the entire stator 6 or rotor 7 preferably consists of the material, from which the support elements 44 are produced.

Due to the plastic deformation, it is possible that the support elements 44 are at least partially compressed, whereby the effort for their removal from the planar surfaces 33, 35, 39, 40 can be reduced.

Merely for the sake of completeness, it should be mentioned that the support elements 44 serve to support the stator 6 and/or the rotor 7 on a support surface, in particular a support surface of the clamping device 42, during the grinding and/or finishing of the planar surfaces 33, 35 or 39, 40.

For the sake of completeness, it should be mentioned that the camshaft adjuster 2 has a covering 8, 41 on both sides (on the axial end faces), by means of which the working spaces 18 are closed in the axial direction 21.

According to the described method, a single-piece stator 6 for a camshaft adjuster 2 can be produced from a sintering material, comprising a stator base body 9, which has an outer spur gearing 5, a radially inner lateral surface 10 and webs 11 protruding radially inwards from the radially inner lateral surface 10, which webs 11 are distanced from one another in the circumferential direction 13 of the stator base body 9, wherein the stator 6 has first planar surfaces 33 on a first end face 34 and second planar surfaces 39 on a second end face, which is arranged opposite the first end face 34 when viewed in the axial direction 21, wherein the first planar surfaces 33 and the second planar surfaces 39 of the stator 6 are ground or finished, and at least the lateral surface 10 is uncalibrated and unground.

It is further possible to produce a single-piece rotor 7 for a camshaft adjuster 2 from a sintering material with this method, comprising a rotor base body 14, which has blades 16 protruding radially outwards from a radially outer lateral surface 15, wherein the rotor 7 has first planar surfaces 35 on a first end face 36 and second planar surfaces 40 on a second end face, which is arranged opposite the first end face 36 when viewed in the axial direction 21, wherein the first planar surfaces 35 and the second planar surfaces 40 of the rotor 7 are ground or finished, and the lateral surface 15 of the rotor 7 is uncalibrated and unground.

Preferably, both the stator 6 and the rotor 7 of the camshaft adjuster 2 are formed as sintered components. However, it is also possible that the stator 6 and/or the rotor 7 consist(s) of a solid material, for example a casting material.

In the case of the stator 6, the distance from the first to the second planar surfaces 33, 39 can have a tolerance of 10 μm to 25 μm.

In the case of the rotor 7, the distance from the first to the second planar surfaces 35, 40 can have a tolerance of 8 μm to 25 μm.

Merely for the sake of completeness, it should be noted that it is particularly preferred to use metallic powders as sintering powders.

The exemplary embodiments show possible embodiment variants of the camshaft adjuster 2 and components thereof, while it should be noted at this point that combinations of the individual embodiment variants are also possible.

Finally, as a matter of form, it should be noted that for ease of understanding of the camshaft adjuster 2 and/or its elements, these are not necessarily depicted to scale.

LIST OF REFERENCE NUMBERS

1 Combustion engine
2 Camshaft adjuster
3 Drive wheel
4 Spur gearing
5 Spur gearing
6 Stator
7 Rotor
8 Covering
9 Stator base body
10 Lateral surface
11 Web
12 Recess
13 Circumferential direction
14 Rotor base body
15 Lateral surface
16 Blade
17 Side surface
18 Working space

19 Working chamber
20 Working chamber
21 Axial direction
22 Recess
23 Control valve
24 Section
25 Section
26 Section
27 Opening
28 Piston
29 Arrow
30 Surface
31 Surface
32 Camshaft
33 Planar surface
34 End face
35 Planar surface
36 End face
37 Annular web
38 Hollow cylinder
39 Planar surface
40 Planar surface
41 covering
42 Clamping device
43 layer thickness
44 support element

What is claimed is:

1. A method for producing a hydraulic camshaft adjuster, the method comprising (a) producing a stator including:

a stator base body formed with an outer spur gearing and a radially inner lateral surface, a plurality of webs protruding radially inwards from the radially inner lateral surface, the plurality of webs being circumferentially arrayed about the stator base body, and a first stator planar surface on a first axial end face of the stator base body, and a second stator planar surface on a second axial end face of the stator base body opposite the first axial end face of the stator base body;

(b) producing a rotor configured to rotate relative to the stator, the rotor including:

a rotor base body at least partially arranged in the stator so as to define a plurality of hydraulic working spaces respectively formed between adjacent webs of the plurality of webs, a plurality of blades protruding radially outwards from a radially outer lateral surface of the rotor base body so as to respectively divide each hydraulic working space into a first working chamber and a second working chamber, and a first rotor planar surface on a first axial end face of the rotor base body, and a second rotor planar surface on a second axial end face of the rotor base body opposite the first axial end face of the rotor base body and the first axial end face of the stator base body; and (c) grinding the first stator planar surface, the second stator planar surface, the first rotor planar surface, and the second rotor planar surface while a remaining portion of the stator base body and the rotor base body are left uncalibrated;

wherein the grinding of the first stator planar surface and the first rotor planar surface is performed concurrently with the rotor and the stator arranged on a common clamping device.

2. The method according to claim 1, wherein the grinding of the second stator planar surface and the second rotor planar surface is performed concurrently with the rotor and the stator arranged on the common clamping device.

3. The method according to claim 1, wherein three support elements are formed on at least one of the second stator planar surface and the second rotor planar surface, and wherein the first stator planar surface and the first rotor planar surface are ground before the three support elements are removed and the second stator planar surface and the second rotor planar surface are ground.

4. The method according to claim 3, wherein the three support elements are formed in one piece with the at least one of the second stator planar surface and the second rotor planar surface.

5. The method according to claim 3, wherein the three support elements are produced from a material that is configured to plastically deform during assembly of the camshaft adjuster.

6. The method according to claim 3, wherein the three support elements are produced from a polymer-based material.

7. The method according to claim 3, wherein the three support elements are formed to be knob-shaped.

8. A hydraulic camshaft adjuster comprising:

a single-piece rotor made from a sintering material, the rotor including:

a rotor base body;

a plurality of blades protruding radially outwards from a radially outer lateral surface of the rotor base body; and a first rotor planar surface on a first axial end face of the rotor base body, and a second rotor planar surface on a second axial end face of the rotor base body opposite the first axial end face of the rotor base body, and a single-piece stator made from a sintering material, the stator including:

a stator base body formed with an outer spur gearing and a radially inner lateral surface;

a plurality of webs protruding radially inwards from the radially inner lateral surface, the plurality of webs being circumferentially arrayed about the stator base body; and a first stator planar surface on a first axial end face of the stator base body, and a second planar surface on a second axial end face of the stator base body opposite the first axial end face of the stator base body, wherein the first stator planar surface and the second stator planar surface are ground while a remaining portion of the stator base body is left uncalibrated, and wherein the grinding of the first stator planar surface and the first rotor planar surface is performed concurrently with the rotor and the stator arranged on a common clamping device.

* * * * *